US007997827B2

(12) United States Patent
Fogg

(10) Patent No.: US 7,997,827 B2
(45) Date of Patent: Aug. 16, 2011

(54) WATERCRAFT SUPPORT AND TOTE DEVICE

(76) Inventor: Ryan Patrick Fogg, Hudsonville, MI (US)

( * ) Notice: Subject to any disclaimer, the term of this patent is extended or adjusted under 35 U.S.C. 154(b) by 215 days.

(21) Appl. No.: 11/982,834

(22) Filed: Nov. 5, 2007

(65) Prior Publication Data

US 2008/0181724 A1 Jul. 31, 2008

Related U.S. Application Data

(60) Provisional application No. 60/856,705, filed on Nov. 3, 2006.

(51) Int. Cl.
*B63C 3/12* (2006.01)
*B60P 3/10* (2006.01)

(52) U.S. Cl. ..... 405/3; 414/459; 414/460; 254/324

(58) Field of Classification Search ..... 405/1, 3; 414/459, 460; 212/343–345; 254/323, 324, 254/327, 338

See application file for complete search history.

(56) References Cited

U.S. PATENT DOCUMENTS 298,405 A * 5/1884 Reitz ..... 254/324
3,161,309 A * 12/1964 Baudhuin et al. ..... 414/459
3,251,496 A * 5/1966 Lamer et al. ..... 414/459
3,494,492 A * 2/1970 Thiermann ..... 414/461
3,896,892 A 7/1975 Kohls et al.
3,973,754 A * 8/1976 Chadwick, Jr. ..... 254/323
4,236,859 A * 12/1980 Stearn et al. ..... 414/460
4,378,072 A * 3/1983 Appleman et al. ..... 212/344
4,715,762 A * 12/1987 Lanigan et al. ..... 414/460
4,830,387 A * 5/1989 Batten ..... 414/460
4,861,218 A * 8/1989 Lamer ..... 254/324
5,016,893 A * 5/1991 Hart, Jr. ..... 280/35
5,037,237 A * 8/1991 Anteau ..... 405/3
5,180,070 A * 1/1993 Feider ..... 212/324
5,396,857 A 3/1995 Emery, Jr.
5,417,447 A 5/1995 Godbersen
5,431,122 A 7/1995 Templet, Jr.
5,722,809 A 3/1998 Urbank
5,810,183 A * 9/1998 Feider et al. ..... 414/460
5,961,139 A 10/1999 Nichols, II
6,193,086 B1 * 2/2001 Gunnlaugsson et al. ..... 212/344
6,276,469 B1 8/2001 Smith
6,361,060 B1 3/2002 Kamminga
6,457,904 B2 * 10/2002 Bishop et al. ..... 405/3
6,869,094 B2 3/2005 Fogg
7,070,060 B1 * 7/2006 Feider et al. ..... 212/344
2002/0134295 A1 9/2002 Chimato
2005/0019142 A1 * 1/2005 Miles et al. ..... 414/460

FOREIGN PATENT DOCUMENTS

JP 10-324111 12/1998

* cited by examiner

*Primary Examiner* — Frederick L Lagman
(74) *Attorney, Agent, or Firm* — King & Partners, PLC

(57) ABSTRACT

A watercraft support and tote device having a frame sub-assembly having a first frame member and a second frame member and at least one support member; a power output member; a hydraulic sub-assembly having a hydraulic vessel, a control system, and a conduit; at least one ground engaging wheel; a drive member; a winch; and a plurality of watercraft support members.

19 Claims, 6 Drawing Sheets

WATERCRAFT SUPPORT AND TOTE DEVICE

CROSS-REFERENCE TO RELATED APPLICATION(S)

This application claims the benefit of U.S. Provisional Application Ser. No. 60/856,705, filed Nov. 3, 2006, entitled "WATERCRAFT CRADLE AND TOTE DEVICE," which is hereby incorporated herein by reference in its entirety, including all references cited therein.

BACKGROUND OF THE INVENTION

1. Field of the Invention

The present invention relates in general to a support and tote device, and more particularly to a support and tote device for watercrafts—such as personal watercrafts, boats, and/or other marine vessels.

2. Background Art

From small ponds, lakes, and rivers, to large bodies of water like the Great Lakes and Oceans, the use of watercrafts has become quite common. As such, watercraft use has become popular among all types of people, from adults to children, and includes both men and women, and certain difficulties have been encountered.

In particular, certain watercraft can be quite heavy (300 to 5,000+ pounds). As such, it is often difficult for a user to transport the watercraft from the beach or other storage area to the water—and vice versa. In addition, such watercraft generally comprise fiberglass and/or inflatable regions, etc., that can be damaged by dragging the same across the ground and/or beach.

While carts or totes have been utilized to overcome such difficulties, current devices are replete with drawbacks. For example, many totes include relatively small wheels and components, which may assist in the storage and toting of a watercraft, but are not generally compatible with rugged terrain at the water's edge—which is very common. Other totes provide larger wheels to tackle such terrain, but are operated manually and generally require a great deal of strength to operate. Lastly, U.S. Pat. No. 6,869,094, issued to Fogg, discloses a submersible watercraft stand and tote device which engages and supports the hull of an associated watercraft. However, water/wave conditions can render use of the device problematic. Current devices which engage and support the hull of an associated watercraft typically require a high level of accuracy to position the watercraft so that the device properly engages the hull, and therefore the watercraft, in a stable and balanced configuration. Wave and water conditions can make such a task arduous if not impossible.

It is therefore, an object of the present invention to provide a watercraft support and tote device which enables a user to deploy, retrieve, and/or transport a watercraft in a manner which overcomes the drawbacks associated with current stand and tote devices.

SUMMARY OF THE INVENTION

In one embodiment, the present invention is directed to a watercraft support and tote device, comprising: (a) a frame sub-assembly, wherein the frame sub-assembly comprises: (1) a first frame member and a second frame member, wherein the first and second frame members are spaced apart from one another; and (2) at least one support member, wherein the at least one support member is positioned between the first and second frame members; (b) a power output member, wherein the power output member is associated with the frame sub-assembly, and further wherein the power output member communicates with a hydraulic sub-assembly; (c) a hydraulic sub-assembly, wherein the hydraulic sub-assembly comprises: (1) a hydraulic vessel, wherein the hydraulic vessel is capable of containing hydraulic fluid; (2) a control system, wherein the control system directs displacement of the watercraft support and tote device; and (3) a conduit, wherein the conduit communicates with a drive member; (d) at least one ground engaging wheel, wherein at least one ground engaging wheel is associated with the frame sub-assembly; (e) a drive member, wherein the drive member is in communication with the hydraulic sub-assembly and at least one of the at least one ground engaging wheel; (f) a winch, wherein the winch is associated with the frame sub-assembly, and further wherein the winch raises/lowers an associated watercraft via a rigging sub-assembly; and (g) a plurality of watercraft support members, wherein the plurality of watercraft support members are associated with the rigging sub-assembly, and further wherein the plurality of support members supportingly contact the side of an associated watercraft when in an engaged position.

In a preferred embodiment of the present invention, the first frame member and the second frame member are positioned in a substantially inverted u-spaced configuration.

In another preferred embodiment of the present invention, both the first frame member and the second frame member have a generally tubular cross-sectional geometry.

In yet another preferred embodiment of the present invention, the first frame member comprises a first end and a second end and an apex point, wherein the apex point is positioned above and between the first end of the second frame member and the second end of the first frame member, and the second frame member comprises a first end and a second end and an apex point, wherein the apex point is positioned above and between the first end of the second frame member and the second end of the second frame member.

In another aspect of the present invention, the at least one support members consists of a port support member, wherein the port support member is fixedly attached to the first end of the first frame member and the first end of the second frame member, a starboard support member, wherein the starboard support member is fixedly attached to the second end of the first frame member and the second end of the second frame member and an apex support member, wherein the apex support member is fixedly attached to the apex point of the first frame member and the apex point of the second frame member.

In yet another preferred embodiment of the present invention, the power output member comprises an internal combustion engine.

In another preferred embodiment of the present invention the power output member comprises an electric motor.

In one preferred embodiment of the present invention, the power output member is associated with the frame sub-assembly via attachment to a power output bracket associated with the frame sub-assembly.

In a preferred embodiment of the present invention, the drive member comprises a chain drive train.

In another preferred embodiment of the present invention, the at least one ground engaging wheel is associated with an axle and a drive gear, wherein the axle is attached to the at least one ground engaging wheel and the drive gear is attached to the axle, and further wherein the drive gear is associated with the drive member.

In yet another preferred embodiment of the present invention, the watercraft support and tote device further comprises a first wheel, a second wheel, a third wheel, and a fourth wheel, and wherein the first wheel is associated with the first end of the first frame member, the second wheel is associated with the first end of the second frame member, third wheel is associated with the second end of the first frame member, and the fourth wheel is associated with the second end of the second frame member, and the first and second wheels are in communication via a first drive member, and the third and fourth wheels are in communication via a second drive member.

In another aspect of the present invention, the control system comprises at least two control sticks, and further wherein displacement of at least one of the at least two control sticks engages the hydraulic sub-assembly that turns a drive member which rotates at least one ground engaging wheel.

In one preferred embodiment of the present invention, the at least two control sticks comprise a left control stick and a right control stick, and further wherein each control stick comprises a neutral position, a forward position and a reverse position, whereby when both the left control stick and the right control stick are in the forward position, the watercraft support translates forward, and further whereby when both the left and right control sticks are in the reverse position, the watercraft support translates in reverse, and further whereby when the left control stick is in the forward position and the right control stick is in the reverse position, the watercraft traverses a substantially zero radius turn in the clockwise direction, and further whereby when the right control stick is in the forward position and the left control stick is in the reverse position, the watercraft traverses a substantially zero radius turn in the counter-clockwise direction.

In a preferred embodiment of the present invention, the rigging sub-assembly comprises a pulley system associated with the winch and a plurality of rigging lines associated with the plurality of watercraft support members.

In another preferred embodiment of the present invention, the apex support member comprises a length, and wherein the pulley system is positioned and attached to the apex support member at a distance equal to ½ the length of the apex support member.

In yet another preferred embodiment of the present invention, the watercraft support and tote device comprises a port watercraft support member and a starboard watercraft support member, and further wherein the port watercraft support member comprises a first end and a second end and the starboard watercraft support member comprises a first end and a second end, and wherein at least a portion of the port watercraft support member comprises a substantially c-shaped channel which engage the port side of an associated watercraft, and wherein at least a portion of the starboard watercraft support member comprises a substantially c-shaped channel which engage the port side of an associated watercraft.

In another aspect of the present invention, the plurality of watercraft support members comprise a port watercraft support member and a starboard watercraft support member, and further wherein the port watercraft support member comprises a first end and a second end and the starboard watercraft support member comprises a first end and a second end, and wherein at least one the first end and second end of the port watercraft support member comprise a substantially c-shaped channel which engage the port side of an associated watercraft, and wherein at least one the first end and second end of the starboard watercraft support member comprise a substantially c-shaped channel which engage the port side of an associated watercraft.

In one preferred embodiment of the present invention, the plurality of support members each comprise a handle, and wherein the handle is positioned and attached to the plurality of support members at a distance equal to ½ the length of the plurality of support members.

In a preferred embodiment of the present invention, the watercraft support and tote device according further comprises a plurality of stabilizers associated with the frame sub-assembly and the plurality of support members, such that when a watercraft is associated with the watercraft support, the plurality of stabilizers substantially precludes a watercraft from swinging movements.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
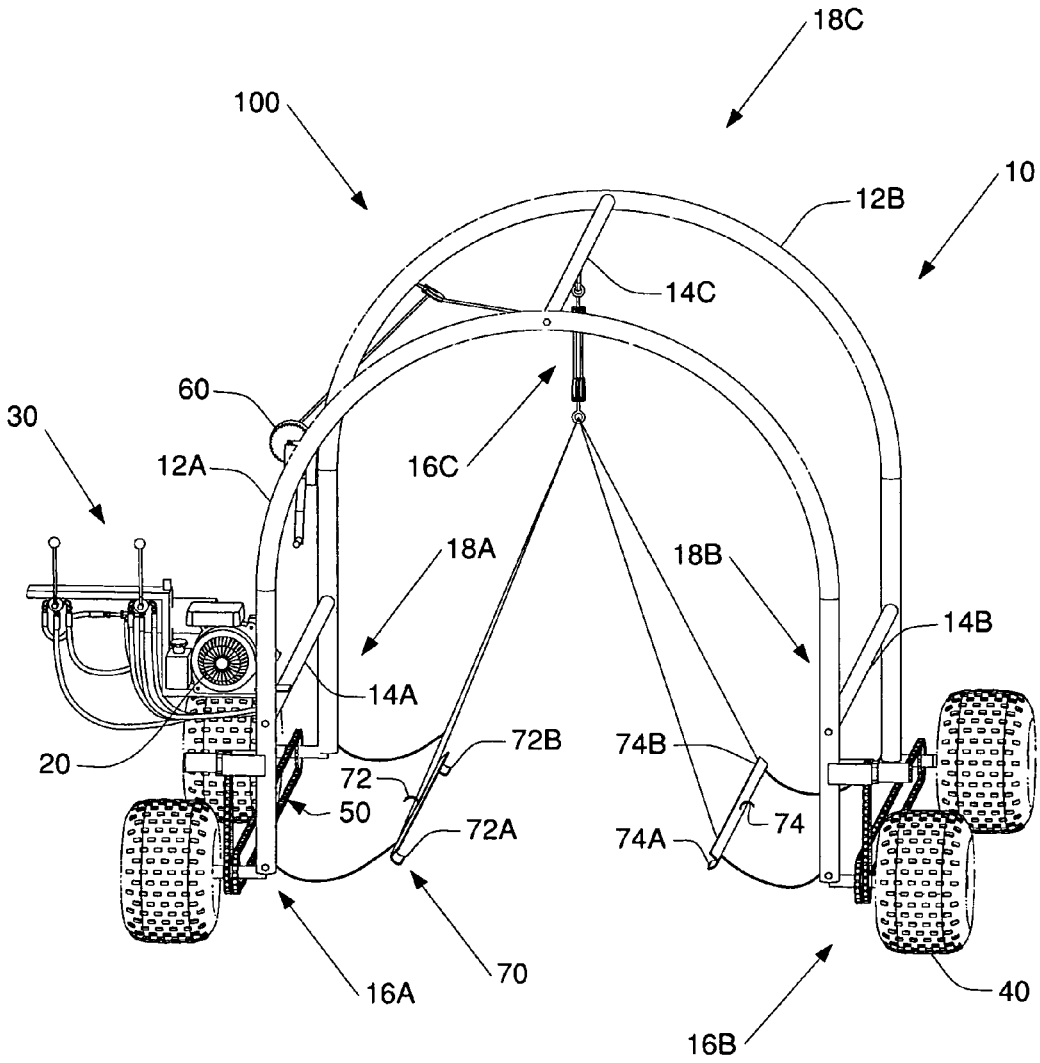
FIG. 1 is a perspective view of a watercraft support and tote device in accordance with the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to FIG. 1, watercraft support and tote device 100 is shown as generally comprising frame sub-assembly 10, power output member 20, hydraulic sub-assembly 30, at least one ground engaging wheel 40, drive member 50, winch 60, and plurality of watercraft support members 70.

Frame sub-assembly 10 is shown as preferably comprising first frame member 12A, second frame member 12B, port support member 14A, starboard support member 14B, and apex support member 14C. First frame member 12A comprises first end 16A, second end 16B and apex point 16C. Second frame member 12B comprises first end 18A, second end 18B and apex point 18C.

In accordance with the present invention, both first frame member 12A and second frame member 12B are preferably positioned in a substantially inverted u-shaped configuration and are spaced apart from one another by support members 14A, 14B and 14C. Also, both first frame member 12A and second frame member 12B are preferably fabricated with a substantially tubular cross-sectional geometry, but one of ordinary skill in the art will appreciate that the described structure may comprise any suitable geometry (e.g. square, triangular, hexagonal, etcetera).

Port support member 14A is fixedly attached to first end 16A of first frame member 12A and first end 18A of second frame member 12B. Starboard support member 14B is fixedly attached to second end 16B of first frame member 12A and second end 18B of second frame member 12B. Apex support member 14C is fixedly attached to apex point 16C of first frame member 12A and apex point 18C of second frame member 12B. Support members 14A, 14B, and 14C are attached to first frame member and second frame member via any conventional securing method, such as, but not limited to, fusing, welding, threaded and non-threaded fasteners, rivets—just to name a few.

Figure 2:
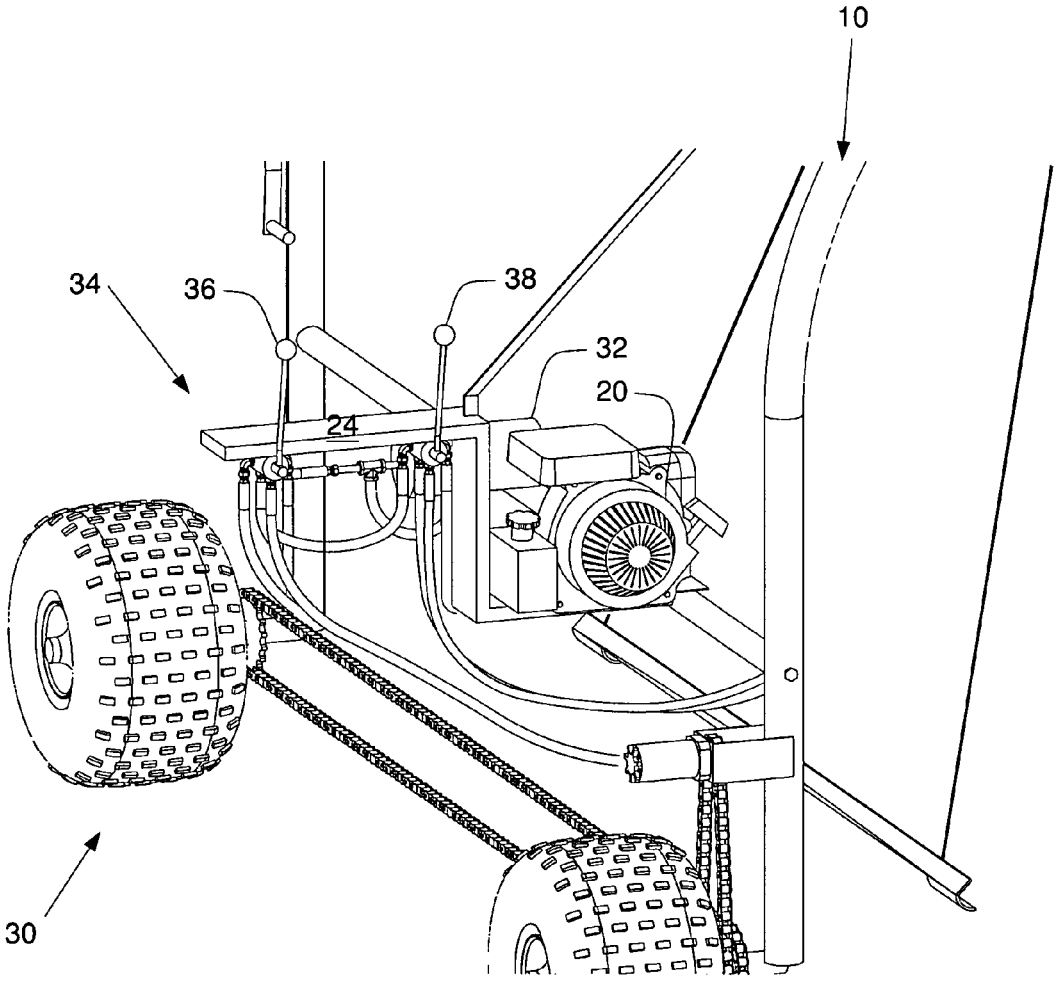
FIG. 2 is a fragmented view of a hydraulic sub-assembly and power output member in accordance with the present invention.

Referring now to FIG. 2, power output member 20 is shown connected to frame sub-assembly 10 via power output bracket 24. Power output member 20 is preferably attached to frame sub-assembly 10 via any conventional securing method, such as, but not limited to, fusing, welding, threaded and non-threaded fasteners, rivets. In one embodiment, power output bracket 24 comprises a flat support plate with attachments (e.g. clamps, bolts, etcetera) that secure power output member 20 to power output bracket 24.

In one preferred embodiment of the present invention, power output member 20 comprises an internal combustion engine, but one of ordinary skill in the art will appreciate that the described element may comprise any suitable powering means, such as, but not limited to, electric motors or hybrid internal combustion/electric engines.

Figure 6:
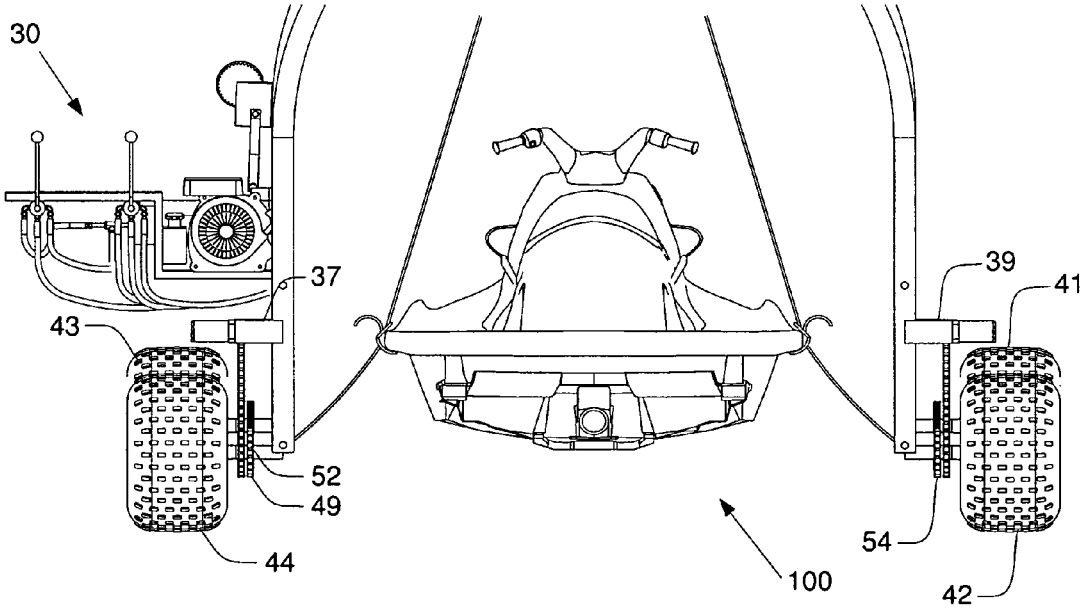
FIG. 6 is a rear plan view of watercraft support and tote device with an associated watercraft in accordance with the present invention.

Hydraulic sub-assembly 30 is shown as generally comprising hydraulic vessel 32, control system 34, port conduit 37 (see FIG. 6) and starboard conduit 39 (see FIG. 6). Hydraulic sub-assembly is powered by power output member 20. Hydraulic vessel 32 is also connected to power output bracket 24 via any conventional securing method, such as, but not limited to, fusing, welding, threaded and non-threaded fasteners, rivets—just to name a few. Hydraulic vessel 32 contains hydraulic fluid necessary to operate hydraulic sub-assembly 30.

Control system 34 is shown as generally comprising left control stick 36 and right control stick 38. Both control sticks 36 and 38 comprise a neutral position, a forward position, and a reverse position. Control system 34 is connected to hydraulic vessel 32 via typical hydraulic hoses, and controls the flow of hydraulic fluid throughout hydraulic sub-assembly 30. Port conduit 37 comprises gears which turn in response to the flow of hydraulic fluid from hydraulic vessel 32. Also, starboard conduit 39 comprises gears which turn in response to the flow of hydraulic fluid from hydraulic vessel 32. It will be understood that all conduits 37 and 39 will preferably comprise a motor with an output shaft having associated gears. Hydraulic vessel 32, control system 34, port conduit 37 and starboard conduit 39 are all in connection with one another via typical hydraulic hoses.

Figure 3:
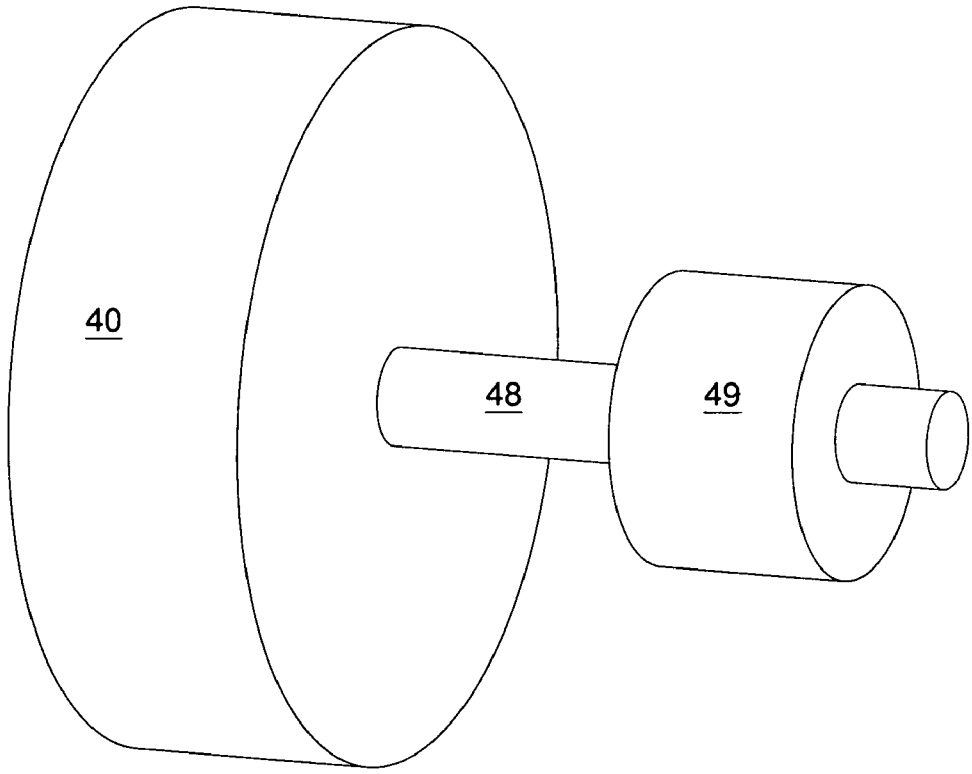
FIG. 3 is a perspective, fragmented view of a ground engaging wheel in accordance with the present invention.

FIG. 3 shows, among other things, ground engaging wheel 40. Axle 48 and drive gear 49 are shown as associated with wheel 40. Preferably, all wheels comprise an axle 48 and drive gear 49. Axles are connected to wheels via any conventional securing method, such as, but not limited to, fusing, welding, threaded and non-threaded fasteners, rivets. Drive gear 49 is preferably a typical gear with teeth, and is connected to axle 48. Connections may include compression fittings, or cotter keys, etcetera. Axles and drive gears may be fabricated as a unitary member.

Figure 4:
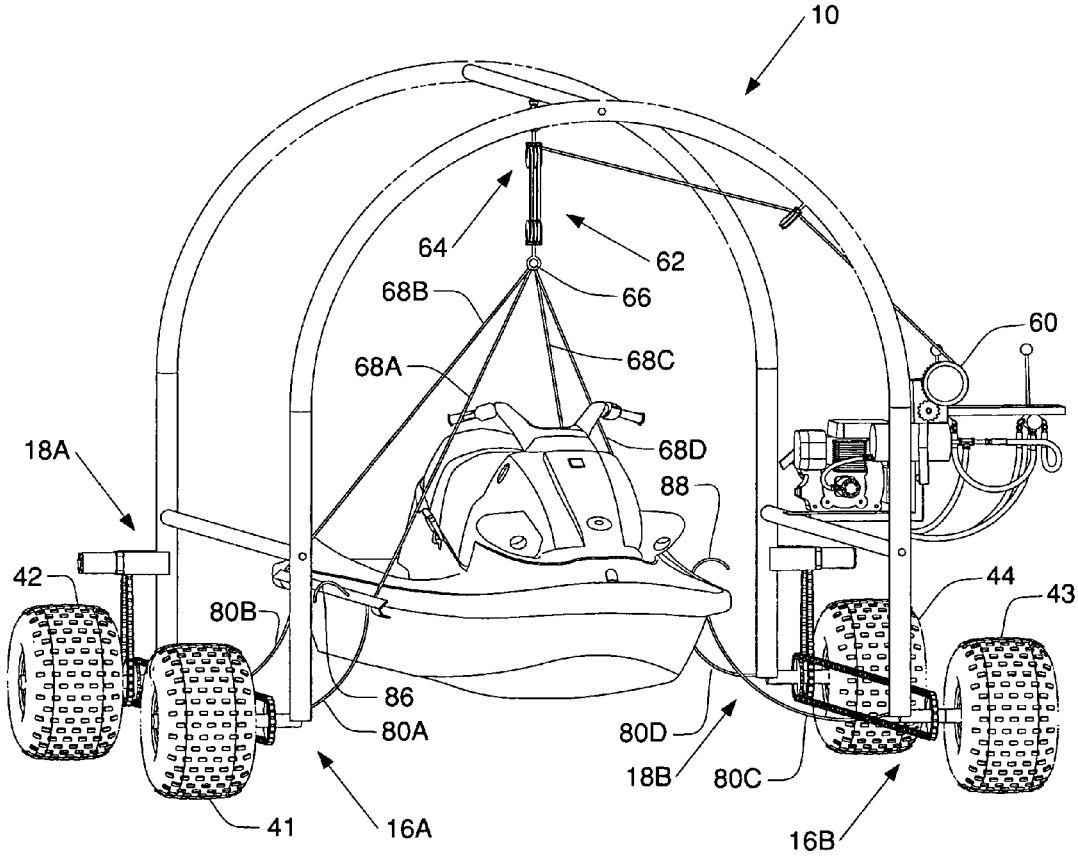
FIG. 4 is a perspective view of a watercraft support and tote device with an associated watercraft in accordance with the present invention.
Figure 5:
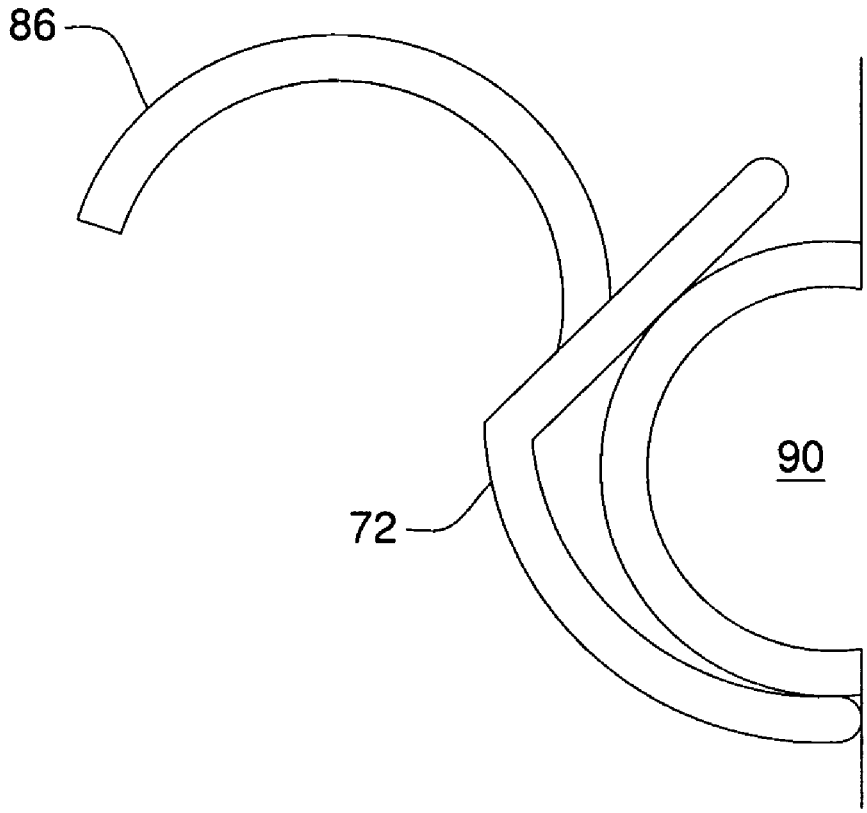
FIG. 5 is a fragmented view of port support member engaged with an associated watercraft in accordance with the present invention.

Referring now to FIG. 4, watercraft support and tote device 100 preferably comprises first wheel 41, second wheel 42, third wheel 43 and fourth wheel 44 which are attached to frame sub-assembly 10.

First wheel 41, is associated with first end 16A of first frame member 12A. Second wheel 42 is associated with the first end 18A of the second frame member 12B. Third wheel 43 is associated with the second end 16B of the first frame member 12A. Lastly, fourth wheel 44 is associated with the second end 18B of the second frame member 12B.

Referring now to FIG. 6, watercraft support and tote device 100 preferably comprises a first drive member 52 and a second drive member 54. Preferably, first drive member 52 and second drive member 54 each comprise a chain drive.

First drive member 52 is connected to first wheel 41 and second wheel 42. Second drive member 54 is connected to third wheel 43 and fourth wheel 44. First drive member 52 is preferably connected to gears associated with port conduit 37, and second drive member 54 is preferably connected to gears associated with starboard conduit.

In operation, when hydraulic sub-assembly 30 is engaged, gears associated with conduits 37 and 38 turn driving first drive member 52 and second drive member 54. Turning both drive members rotates first wheel 41, second wheel 42, third wheel 43, and fourth wheel 44.

Referring back to FIG. 4, winch 60 comprises, for example, a typical hand-cranked winch. Winch 60 is connected rigging assembly 62 via a rope or cable of a sufficient strength for use in lifting objects such as watercraft. Rigging assembly 62 generally comprises pulley system 64, connecting ring 66, first port rope 68A, second port rope 68B, third starboard rope 68C, and fourth starboard rope 68D. First port rope 68A comprises a first end and a second end. Second port rope 68B also comprises a first end and a second end. Likewise, third starboard rope 68C comprises a first end and a second end. Lastly, fourth starboard rope 68D comprise a first end and a second end. Pulley system 64 comprises, for example, a block and tackle. Preferably, first ends of ropes 68A, 68B, 68C, and 68D are all connected to connecting ring 66.

Pulley system 64 is preferably located at a point equidistant between apex point 16C of first frame member 12A and apex point 18C of second frame member 12B, and will preferably be attached to apex support member 14C.

Referring now to FIGS. 1 and 4 collectively, a plurality of watercraft support members 70 are shown as comprising port watercraft support member 72, and starboard support member 74. For purposes of the present disclosure, port watercraft support member 72 comprises first end 72A and second end 72B and starboard watercraft support member 74 comprises first end 74A and second end 74B.

Generally, watercraft support member 72, and starboard support member 74 are connected to the second ends of ropes 68A, 68B, 68C, and 68D. Specifically, second end of first port rope 68A is connected to first end 72A of support member 72, and second end of second port rope 68B is connected to second end 72B of support member 72. Also, first end of third starboard rope 68C is connected to first end 74A of support member 74, and second end of fourth starboard rope 68D is connected to first end 74B of support member 74.

Preferably, at least a portion of port watercraft support member 72 comprises a substantially c-shaped channel which engage port side 92 of associated watercraft 90. Also, at least a portion of starboard watercraft support member 74 comprises a substantially c-shaped channel which engage starboard side 94 of associated watercraft 90. Lastly, port watercraft support member 72 comprises port handle 86 and starboard support member 74 further comprises starboard handle 88.

In one embodiment of the present invention, watercraft support and tote device 100 further comprises first stabilizer 80A, second stabilizer 80B, third stabilizer 80C and fourth stabilizer 80D. Generally, all stabilizers will preferably comprise a chain.

First stabilizer 80A is connected to first end 16A of first frame member 12A and first end 72A of port watercraft support member 72. Second stabilizer 80B is connected to first end 18A of second frame member 12B and second end 72B of port watercraft support member 72. Third stabilizer 80C is connected to second end 16B of first frame member 12A and first end 74A of starboard watercraft support member 74. Fourth stabilizer 80D is connected to second end 18B of second frame member 12B and second end 74B of starboard watercraft support member 74. In operation, the use of stabilizers substantially precludes associated watercraft 90 from unnecessary swinging and unwanted movement.

In operation, user positions watercraft support and tote device 100 over associated watercraft 90. User positions watercraft support and tote device 100 by using control sticks 36 and 38. When both left control stick 36 and right control stick 38 are in the forward position, watercraft support and tote device 100 translates forward. Alternatively, when both left control stick 36 and right control stick 38 are in the reverse position, the watercraft support and tote device 100 translates in reverse. When left control stick 36 is in the forward position and right control stick 38 is in the reverse position, watercraft support and tote device 100 a substantially zero radius turn in the clockwise direction. Also, when right control stick 38 is in the forward position and left control stick 36 is in the reverse position, watercraft support and tote device 100 traverses a substantially zero radius turn in the counter-clockwise direction.

Moving control sticks 36, and 38 causes hydraulic sub-assembly to move first drive member 52 and second drive member 54, depending on which control stick is being moved. Moving drive members 52 and 54 causes first wheel 41, second wheel 42, third wheel 43 and fourth wheel 44 to rotate, displacing watercraft support and tote device 100. It will be understood that the exact wheel rotating at any given time depends on which control stick is being moved.

Once watercraft support and tote device 100 is positioned over associated watercraft 90, port watercraft support member 72 is engaged with port side 92 of associated watercraft 90 and starboard watercraft support member 74 is engaged with starboard side 94 of associated watercraft 90. Engagement of both port watercraft support member 72 and starboard watercraft support member 74 may be facilitated by use of port handle 86 and starboard handle 88, respectively. Preferably, the location of both support members with respect to associated watercraft 90 will be approximately within the center of gravity of associated watercraft 90, such that when associated watercraft 90 is lifted, it is held in balance.

After both support members are engaged a user may operate winch 60 to supportingly contact and lift associated watercraft 90.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A watercraft support and tote device, comprising:

a frame sub-assembly, wherein the frame sub-assembly comprises:

a first frame member and a second frame member, wherein the first and second frame members are spaced apart from one another; and at least one support member, wherein the at least one support member is positioned between the first and second frame members;

a power output member, wherein the power output member is associated with the frame sub-assembly, and further wherein the power output member communicates with a hydraulic sub-assembly;

a hydraulic sub-assembly, wherein the hydraulic sub-assembly comprises:

a hydraulic vessel, wherein the hydraulic vessel is capable of containing hydraulic fluid;

a control system, wherein the control system directs displacement of the watercraft support and tote device; and a conduit, wherein the conduit communicates with a drive member;

at least one ground engaging wheel, wherein least one ground engaging wheel is associated with the frame sub-assembly;

a drive member, wherein the drive member is in communication with the hydraulic sub-assembly and at least one of the at least one ground engaging wheel;

a winch, wherein the winch is associated with the frame sub-assembly, and further wherein the winch raises/lowers an associated watercraft via a rigging sub-assembly; and a plurality of watercraft support members, wherein the plurality of watercraft support members comprise a port watercraft support member and a starboard watercraft support member, and further wherein the port watercraft support member comprises a first end and a second end and the starboard watercraft support member comprises a first end and a second end, and wherein at least a portion of the port watercraft support member comprises a substantially c-shaped channel which engage the port side of an associated watercraft, and wherein at least a portion of the starboard watercraft support member comprises a substantially c-shaped channel which engage the starboard side of an associated watercraft.

2. The watercraft support and tote device according to claim 1, wherein the first frame member and the second frame member are positioned in a substantially inverted u-spaced configuration.

3. The watercraft support and tote device according to claim 2, wherein both the first frame member and the second frame member have a generally tubular cross-sectional geometry.

4. The watercraft support and tote device according to claim 3, wherein the first frame member comprises a first end and a second end and an apex point, wherein the apex point is positioned above and between the first end of the first frame member and the second end of the first frame member, and the second frame member comprises a first end and a second end and an apex point, wherein the apex point is positioned above and between the first end of the second frame member and the second end of the second frame member.

5. The watercraft support and tote device according to claim 3, wherein the at least one support members comprises a port support member, wherein the port support member is fixedly attached to the first end of the first frame member and the first end of the second frame member, a starboard support member, wherein the starboard support member is fixedly attached to the second end of the first frame member and the second end of the second frame member and an apex support member, wherein the apex support member is fixedly attached to the apex point of the first frame member and the apex point of the second frame member.

6. The watercraft support and tote device according to claim 4, wherein the at least one support members comprises a port support member, wherein the port support member is fixedly attached to the first end of the first frame member and the first end of the second frame member, a starboard support member, wherein the starboard support member is fixedly attached to the second end of the first frame member and the second end of the second frame member and an apex support member, wherein the apex support member is fixedly attached to the apex point of the first frame member and the apex point of the second frame member.

7. The watercraft support and tote device according to claim 1, wherein the power output member comprises an internal combustion engine.

8. The watercraft support and tote device according to claim 1, wherein the power output member comprises an electric motor.

9. The watercraft support and tote device according to claim 1, wherein the power output member is associated with the frame sub-assembly via attachment to a power output bracket associated with the frame sub-assembly.

10. The watercraft support and tote device according to claim 1, wherein the drive member comprises a chain drive train.

11. The watercraft support and tote device according to claim 1, wherein the at least one ground engaging wheel is associated with an axle and a drive gear, wherein the axle is attached to the at least one ground engaging wheel and the drive gear is attached to the axle, and further wherein the drive gear is associated with the drive member.

12. The watercraft support and tote device according to claim 1, comprising a first wheel, a second wheel, a third wheel, and a fourth wheel, and wherein the first wheel is associated with the first end of the first frame member, the second wheel is associated with the first end of the second frame member, third wheel is associated with the second end of the first frame member, and the fourth wheel is associated with the second end of the second frame member, and the first and second wheels are in communication via a first drive member, and the third and fourth wheels are in communication via a second drive member.

13. The watercraft support and tote device according to claim 1, wherein the control system comprises at least two control sticks, and further wherein displacement of at least one of the at least two control sticks engages the hydraulic sub-assembly that turns a drive member which rotates at least one ground engaging wheel.

14. The watercraft support and tote device according to claim 13, wherein the at least two control sticks comprise a left control stick and a right control stick, and further wherein each control stick comprises a neutral position, a forward position and a reverse position, whereby when both the left control stick and the right control stick are in the forward position, the watercraft support translates forward, and further whereby when both the left and right control sticks are in the reverse position, the watercraft support translates in reverse, and further whereby when the left control stick is in the forward position and the right control stick is in the reverse position, the watercraft traverses a substantially zero radius turn in the clockwise direction, and further whereby when the right control stick is in the forward position and the left control stick is in the reverse position, the watercraft traverses a substantially zero radius turn in the counter-clockwise direction.

15. The watercraft support and tote device according to claim 1, wherein the rigging sub-assembly comprises a pulley system associated with the winch and a plurality of rigging lines associated with the plurality of watercraft support members.

16. The watercraft support and tote device according to claim 15, wherein the apex support member comprises a length, and wherein the pulley system is positioned and attached to the apex support member at a distance equal to ½ the length of the apex support member.

17. The watercraft support and tote device according to claim 1, further comprising a plurality of stabilizers associated with the frame sub-assembly and the plurality of support members, such that when a watercraft is associated with the watercraft support, the plurality of stabilizers substantially precludes a watercraft from swinging movements.

18. A watercraft support and tote device, comprising:

a frame sub-assembly, wherein the frame sub-assembly comprises:

a first frame member and a second frame member, wherein the first and second frame members are spaced apart from one another; and at least one support member, wherein the at least one support member is positioned between the first and second frame members;

a power output member, wherein the power output member is associated with the frame sub-assembly, and further wherein the power output member communicates with a hydraulic sub-assembly;

a hydraulic sub-assembly, wherein the hydraulic sub-assembly comprises:

a hydraulic vessel, wherein the hydraulic vessel is capable of containing hydraulic fluid;

a control system, wherein the control system directs displacement of the watercraft support and tote device; and a conduit, wherein the conduit communicates with a drive member;

at least one ground engaging wheel, wherein least one ground engaging wheel is associated with the frame sub-assembly;

a drive member, wherein the drive member is in communication with the hydraulic sub-assembly and at least one of the at least one ground engaging wheel;

a winch, wherein the winch is associated with the frame sub-assembly, and further wherein the winch raises/lowers an associated watercraft via a rigging sub-assembly; and a plurality of watercraft support members, wherein the plurality of watercraft support members are associated with the rigging sub-assembly, and further wherein the plurality of support members supportingly contact the side of an associated watercraft when in an engaged position, and further wherein the plurality of support members each comprise a handle, and wherein the handle is positioned and attached to the plurality of support members at a distance equal to ½ the length of the plurality of support members.

19. A watercraft support and tote device, comprising:

a frame sub-assembly, wherein the frame sub-assembly comprises:

a first frame member and a second frame member, wherein the first and second frame members are spaced apart from one another;

at least one support member, wherein the at least one support member is positioned between the first and second frame members; and wherein both the first frame member and the second frame member have a generally tubular cross-sectional geometry a power output member, wherein the power output member is associated with the frame sub-assembly, and further wherein the power output member communicates with a hydraulic sub-assembly;

a hydraulic sub-assembly, wherein the hydraulic sub-assembly comprises:

a hydraulic vessel, wherein the hydraulic vessel is capable of containing hydraulic fluid;

a control system, wherein the control system directs displacement of the watercraft support and tote device; and a conduit, wherein the conduit communicates with a drive member;

at least one ground engaging wheel, wherein least one ground engaging wheel is associated with the frame sub-assembly;

a drive member, wherein the drive member is in communication with the hydraulic sub-assembly and at least one of the at least one ground engaging wheel;

a winch, wherein the winch is associated with the frame sub-assembly, and further wherein the winch raises/lowers an associated watercraft via a rigging sub-assembly; and a port support member, wherein the port support member is fixedly attached to the first end of the first frame member and the first end of the second frame member, a starboard support member, wherein the starboard support member is fixedly attached to the second end of the first frame member and the second end of the second frame member and an apex support member, wherein the apex support member is fixedly attached to the apex point of the first frame member and the apex point of the second frame member.

* * * * *